United States Patent [19]

Jomain

[11] Patent Number: 4,836,776

[45] Date of Patent: Jun. 6, 1989

[54] FURNACE FOR HEAT TREATMENT IN VACUO WITH COOLING BY A STREAM OF GAS

[75] Inventor: Bernard Jomain, Chassieu, France

[73] Assignee: Fours Industriels B.M.I., La Verpilliere Cedex, France

[21] Appl. No.: 180,887

[22] Filed: Apr. 13, 1988

[30] Foreign Application Priority Data

Apr. 28, 1987 [FR] France ..... 87 06214

[51] Int. Cl.[4] ..... F27D 11/02

[52] U.S. Cl. ..... 432/176; 432/205; 415/143; 126/21 A

[58] Field of Search ..... 432/205, 176, 121; 415/52, 53 R, 143; 126/21 A

[56] References Cited

U.S. PATENT DOCUMENTS

| | | | |
|---|---|---|---|
| 2,704,516 | 3/1955 | Mock et al. | 415/53 |
| 4,087,994 | 5/1978 | Goodlaxson | 415/143 |
| 4,093,401 | 6/1978 | Growelle | 415/143 |
| 4,255,080 | 3/1981 | Wilson et al. | 415/53 R |
| 4,516,012 | 5/1985 | Smith et al. | 432/176 |
| 4,560,348 | 12/1985 | Moller et al. | 432/205 |
| 4,596,526 | 6/1986 | Soliman | 432/205 |
| 4,648,377 | 3/1987 | Van Camp | 432/176 |

*Primary Examiner*—Henry C. Yuen

*Attorney, Agent, or Firm*—Dowell & Dowell

[57] ABSTRACT

A furnace for heat treatment in vacuo with cooling by a stream of gas wherein there is a rotating volute mounted between a heat enclosure and a turbine and wherein the rotating volute is in the form of a helical flange arranged on the outside of a hollow cylinder through which gas is directed from the enclosure to the turbine and which volute also includes a gas outlet deflector associated with the helical flange through which gas may be directed toward the heat enclosure.

6 Claims, 3 Drawing Sheets

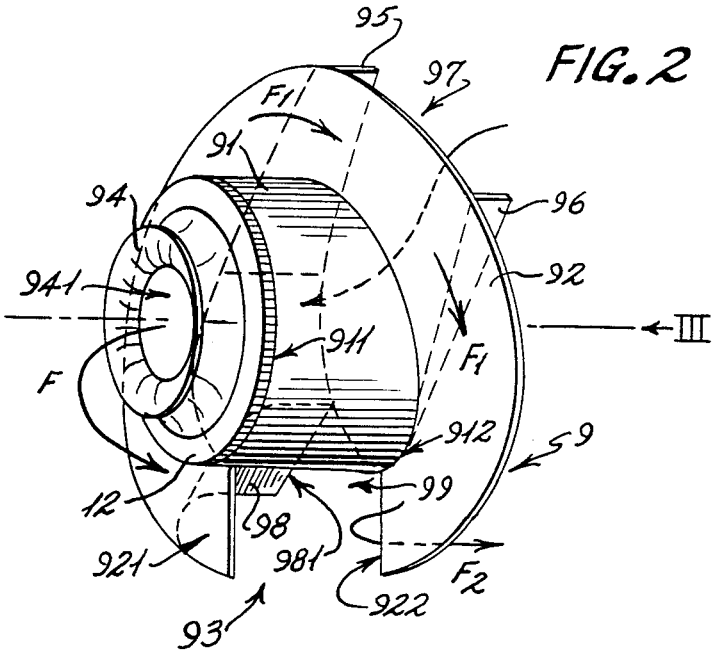
FIG. 2
FIG. 3
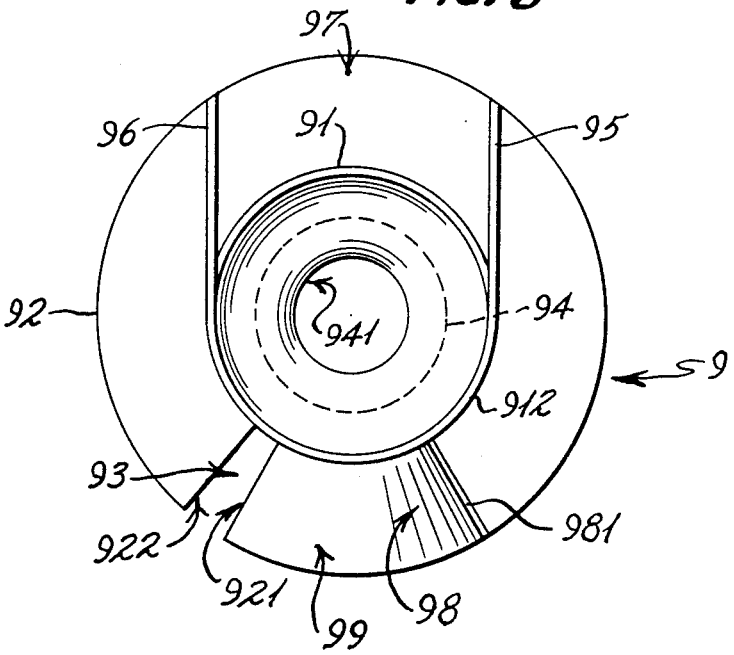

FURNACE FOR HEAT TREATMENT IN VACUO WITH COOLING BY A STREAM OF GAS

BACKGROUND OF THE INVENTION

1. Field of the Invention

The present invention relates to a furnace for heat treatment in vacuo, with cooling by a gas stream.

2. History of the Related Art

It is known that, in furnaces for heat treatment in vacuo comprising a heating enclosure in which is circulated a stream of gas cooled by a temperature exchanger surrounding the turbine which generates the stream, devices have already been provided for reversing the stream in an attempt to cool uniformly all the pieces constituting the charge.

For example, furnaces have already been proposed which are provided with an annular exchanger located downstream of the turbine generating the cooled gas stream and with channels for circulation of the stream provided with registers allowing the reversal of the direction thereof. The presence of the registers creates a flux which penetrates in the heating enclosure only via one of its sides and leaves via its opposite side. Under these conditions, only half of the exchanger is used for cooling the gas. Moreover, very considerable pressure drops occur around the registers and principally in the ring surrounding the turbine since the latter comprises only one output, the other being stopped by the register which is closed. Finally, if it is desired to reverse the direction of the flux by successive closure and opening of the registers, the flowrate of gas passes through a zero value on the charge. The drawbacks set forth above lead to overdimensioning of the motor for driving the turbine of which part of the power is transformed into heat which is completely lost. Finally, scavenging of the charge to be treated is not satisfactory since it is effected only by purely and simply reversing the stream of cooled gas.

Furnaces of the type in question have also been proposed, which present two opposite streams of the cooled gas so as to form eddies or opposing currents in the heating enclosure. There again, there are considerable pressure drops in the ring disposed around the turbine and around the flaps giving access to the channels for distributing the cooled gas, with the result that the power of the motor for driving the turbine must be provided to be greater than is necessary. As in the furnace mentioned hereinabove, the flowrate passes through a zero value, which is detrimental to correct heat treatment of the charge.

SUMMARY OF THE INVENTION

It is an object of the improvements forming the subject matter of the present invention to overcome the above mentioned drawbacks and to produce a furnace for heat treatment in vacuo in which the cooled gas penetrates in the heating enclosure which contains the charge to be treated, effecting an appropriate scavenging so that the charge is perfectly subjected to the action of the cooled gas.

To that end, the cooled gas is sent into the heating enclosure by a rotating volute which, on the one hand, directs the gas towards said enclosure in orientations which vary in time in order to pass through the spaces located between the pieces to be treated in different successive directions and, on the other hand, recovers the used gas to direct it towards the centre of the turbine. A complete scavenging of the charge to be treated is thus effected, without creating pressure drops at the level of the ring surrounding the turbine and in which is located the heat exchanger which is entirely traversed by the gas recycled by the turbine.

In a particularly advantageous embodiment, the rotating volute is in the form of a helical flange arranged on the outside of a hollow cylinder. The cylinder includes at its end where the flange ends in the direction of delivery of the gas, a cut-out which extends by two outwardly directed partitions, constituting a radial passage for recovery communicating with the interior of the cylinder. Between the original edge and the terminal edge of the helical flange, there is a free axial space provided with a deflector adapted to form a window for delivery of the gas under pressure in the direction of the heating enclosure.

BRIEF DESCRIPTION OF THE DRAWINGS

The invention will be more readily understood on reading the following description with reference to the accompanying drawings, in which:

FIG. 2 is a view in perspective of the volute according to the invention.

FIG. 3 is an end view in the direction of arrow III of FIG. 2.

DESCRIPTION OF THE PREFERRED EMBODIMENT

Figure 1:
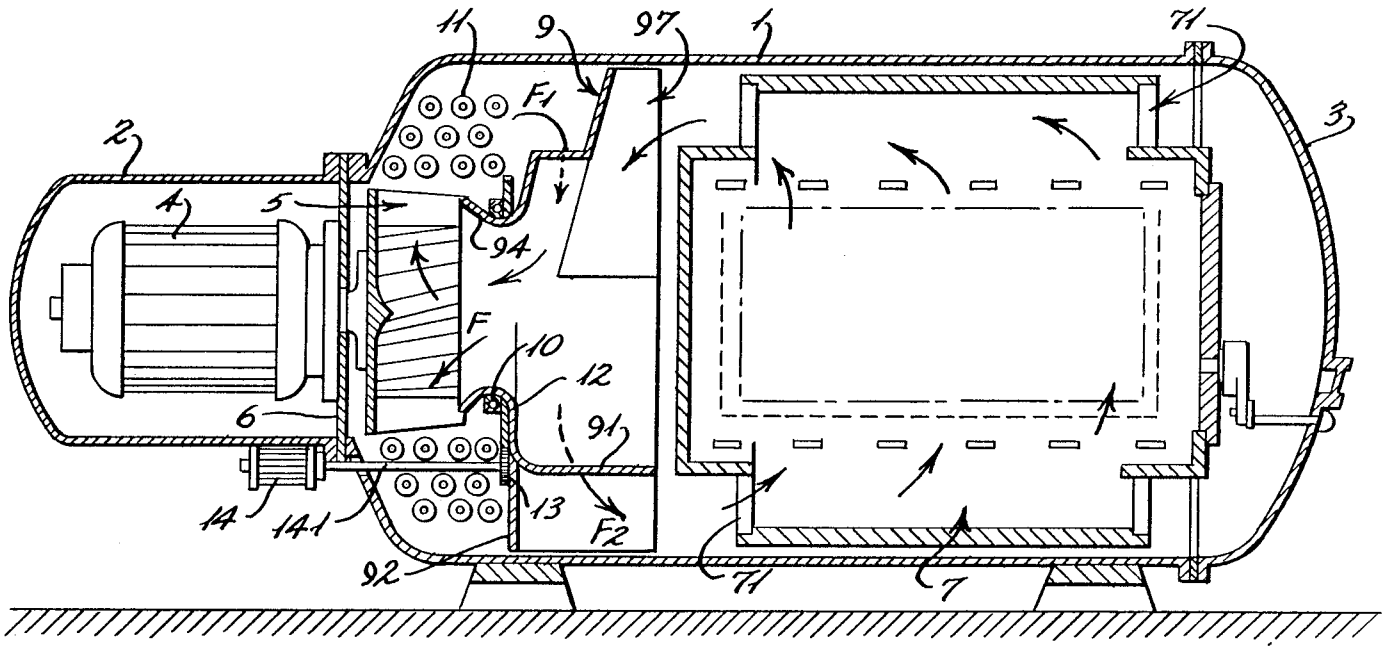
FIG. 1 is a longitudinal section through a furnace incorporating the improvements according to the invention.
Figure 4:
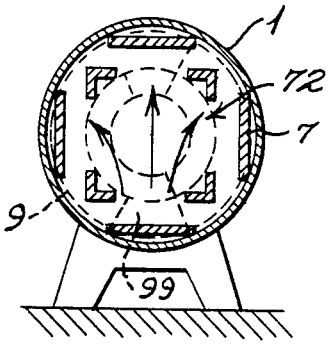
FIGS. 4 to 7 show the manner in which the stream of cooled gas continually changes orientation in the heating enclosure.
Figure 5:
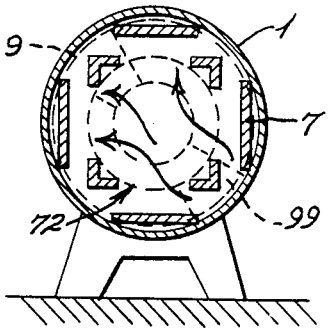
Figure 6:
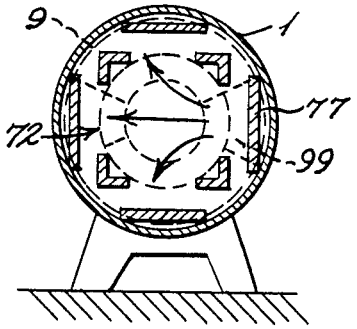
Figure 7:
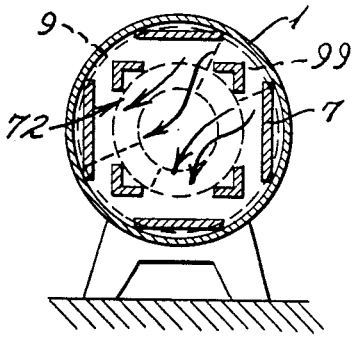

Referring now to the drawings, the furnace according to the invention, illustrated in FIG. 1, essentially comprises, in conventional manner, a cylindrical outer envelope 1 of which the rear is associated with a bell 2 while its front part is closed by a door 3. In the bell 2 is located an electric motor 4 driving a turbine 5 by a shaft passing through a tight partition 6 closing the envelope 1 opposite the door 3 and from which the bell 2 starts.

The envelope 1 contains an enclosure or laboratory 7 in which is placed a charge 8 to be treated, illustrated in broken lines and constituted by a multiplicity of separate pieces stacked on a platform (not shown). It will be noted that the enclosure 7 is provided with openings 71 disposed at the level of its two bottom ends, while other openings 72 are arranged on the lateral walls (FIGS. 4 to 7).

In accordance with the invention, a rotating air deflecting volute 9, more particularly illustrated in Figs. 2 and 3, has been placed between the turbine 5 and the heating enclosure 7. This volute is mounted to rotate with respect to the envelope 1 by means of a roller bearing 10. Also observed is the presence in the envelope of a heat exchanger 11 located in the space defined between said turbine and the volute 9. A toothed ring 12 is associated with the volute 9 and meshes with a pinion 13 mounted at the end of a shaft 141 constituting the extension of the driven shaft of an electric motor 14. As will be explained in greater detail hereinafter, the electric motor 14 drives the volute 9 in continuous or discontinuous rotation.

The volute 9 firstly comprises a hollow cylinder 91 (FIGS. 2 and 3) around which is wound a helical flange 92 of which the original edge 921 lies at one of the ends 911 of the cylinder 91, while the end edge 922 of the flange 92 ending at the other end 912 of the cylinder 91 lies substantially opposite edge 921 to define a free axial passage 93. The end 911 of the cylinder 91 located at the level of edge 921 comprises a bottom in the form of a chimney 94 presenting in transverse section the form of a rounded double funnel, having an opening 941 at its centre.

That part of the hollow cylinder 91 projecting beyond the helicoidal flange 92 with respect to the chimney 94 is cut along a diameter so that its remaining part is joined to two partitions 95, 96 disposed in parallel with respect to each other and issuing from the two edges thus determined on a diameter of the hollow cylinder 91. These two partitions therefore extend outwardly and define a radial channel 97 for gas recovery, which communicates with the interior of the hollow cylinder 91.

It will be observed that a deflector 98 of rounded form leaves from the edge 921 and from the helicoidal flange 92, which deflector ends beneath the end 911 of the hollow cylinder 91 along an edge 981 lying opposite edge 922 of the flange. These two edges, located in the same transverse plane, determine a window 99 disposed diametrally opposite with respect to the recovery channel 97 at the level of end 912 of the cylinder 91.

The presence will be observed of the toothed ring 12 on the end 911 of the cylinder 91.

It will be readily understood that the turbine 5 sucks the gas contained in the envelope 1 at the level of its heating enclosure 7 through the central opening 941 of the volute 9. This sucked gas is delivered radially and is cooled in contact with the heat exchanger 11, in the direction of arrows F. After having cooled in contact with the elements of this exchanger, the gas is projected against that face of the helicoidal flange 92 located opposite said exchanger 11, with the result that it rotates in the direction of arrows F1 to arrive at passage 93 which it traverses, to be returned by deflector 98 in an axial direction illustrated by arrow F2. The stream of gas thus delivered penetrates in the enclosure 7 via one or two adjacent openings 71, 72 in this enclosure and leaves through one or two corresponding openings disposed diametrally opposite in this enclosure.

FIGS. 4 to 7 illustrate the manner in which the gas passes through the charge 8. It has been assumed in FIG. 4 that the delivery window 99 is located in the lower part of the envelope 1, with the result that the gas penetrates into enclosure 7 from underneath, to rise and escape through the other openings in this enclosure. The gas reheated in the enclosure 2 in contact with the charge 8 is then recovered in the channel 97 to be conducted inside the volute 9 from which it is sucked by the turbine 5.

It will be readily understood that, as the volute 9 rotates, the orientation of the stream of cold gas changes, with the result that scavenging of the pieces constituting the charge is perfectly ensured. These variations in orientation are particularly well illustrated by the arrows in FIGS. 4 to 7. Of course, if it is desired to privilege a certain direction of flow of the cold gas, it is possible to stop the motor 14 or to supply it in cyclic manner, so that the volute stops for a certain length of time in a determined orientation, then starts again, and so on.

A furnace has thus been produced, ensuring maximum yield of the turbine without considerable pressure drops and in any case without variation thereof since they are identical whatever the position of the volute. Similarly, the maximum air flowrate is constant in all the positions of said volute. Finally, the yield of the heat exchanger is maximum since the air delivered by the turbine passes through it entirely.

It must, moreover, be understood that the foregoing description has been given only by way of example and that it in no way limits the domain of the invention which would not be exceeded by replacing the details of execution described by any other equivalents.

What is claimed is:

1. In a furnace for heat treating articles and in which includes a housing, an enclosure mounted within the housing in which articles are placed, a turbine rotatably mounted within the housing for circulating gas relative to a heat exchanger also mounted within the housing and the enclosure, the improvement comprising an air deflection volute means mounted within said housing between the enclosure and the turbine so that air passing between the enclosure and the turbine passes therethrough, drive means for rotating said volute means within the housing, a plurality of openings into the enclosure through which gas is circulated relative to articles placed therein, said volute means including a gas inlet and gas outlet portions for directing gas to the turbine and from the turbine toward the enclosure respectively, said gas outlet portion being reoriented with respect to the enclosure as said volute means is rotated to thereby continuously alter the direction of gas flow relative to the articles in the enclosure.

2. The furnace of claim 1 wherein said inlet portion of said volute means includes a generally central cylindrical hub having first and second ends and an openng therethrough, said first end of said hub being oriented toward the turbine and said second end being oriented toward the enclosure, a helical flange mounted on said hub and having first and second end edges, said helical flange extending substantially around said hub with said first edge being adjacent said first end of said hub and said second edge being oriented generally oppositely thereto adjacent said second end of said hub, said second end of said hub including a sloped portion which tapers toward said first end along the helical line defined by said helical flange, a pair of spaced generally parallel partitions mounted to said helical flange and extending outwardly from said sloped portion and on opposite sides of said opening through said hub to thereby define a gas flow directing channel which communicates with said opening through said cylinder for directing gas from the enclosure into the turbine.

3. The furnace of claim 2 wherein said outlet portion of said volute means includes an axial open space which is created along the length of the hub and between said first and second edges of said helical flange, a deflection plate extending from adjacent said first edge of said helical flange toward said second end of said hub, said deflection plate being spaced from said second edge of said helical flange whereby gas from the turbine is directed along said helical flange to said deflection plate and therefrom through said axial open space to the enclosure.

4. The furnace of claim 3 wherein the outlet portion of said volute means is diametrically opposite said gas flow directing channel defined between said generally parallel partitions.

5. The furnace of claim 4 wherein said volute means includes an annular funnel means extending from said first end of said hub, said annular funnel means having an opening therein which is smaller than the opening through said hub.

6. The furnace of claim 1 in which said drive means includes a tooth ring mounted around said volute means, a pinion mounted in meshed configuration with said tooth ring, and motor means for rotating said pinion.

* * * * *